US009181849B2

(12) United States Patent
Takemoto

(10) Patent No.: US 9,181,849 B2
(45) Date of Patent: Nov. 10, 2015

(54) COOLING DEVICE FOR ENGINE

(75) Inventor: Daisuke Takemoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 13/813,269

(22) PCT Filed: Dec. 28, 2011

(86) PCT No.: PCT/JP2011/080499

§ 371 (c)(1),
(2), (4) Date: Feb. 11, 2013

(87) PCT Pub. No.: WO2012/096140

PCT Pub. Date: Jul. 19, 2012

(65) Prior Publication Data

US 2013/0139768 A1 Jun. 6, 2013

(30) Foreign Application Priority Data

Jan. 11, 2011 (JP) ..... 2011-003476

(51) Int. Cl.
*F01P 1/04* (2006.01)
*F01P 3/08* (2006.01)
(Continued)

(52) U.S. Cl.
CPC .. *F01P 3/08* (2013.01); *F01M 1/08* (2013.01); *F01M 1/16* (2013.01); *F01P 3/06* (2013.01);
(Continued)

(58) Field of Classification Search
CPC ..... F01M 1/08; F01M 1/16; F01M 5/005; F01P 3/08; F01P 2003/008; F01P 2023/08; F02D 41/06
USPC ..... 123/41.02, 41.45, 41.73, 41.35, 41.42, 123/41.64
See application file for complete search history.

(56) References Cited

U.S. PATENT DOCUMENTS 3,485,324 A * 12/1969 Novak ..... 184/6
4,399,774 A 8/1983 Tsutsumi
(Continued)

FOREIGN PATENT DOCUMENTS

CN 101865016 A 10/2010
CN 101871381 A 10/2010
(Continued)

OTHER PUBLICATIONS

Chinese Office Action and Search Report, dated Jun. 4, 2014, for Chinese Application No. 201180037710.6 with an English translation.
(Continued)

*Primary Examiner* — Lindsay Low
*Assistant Examiner* — Long T Tran
(74) *Attorney, Agent, or Firm* — Birch, Stewart, Kolasch & Birch, LLP

(57) ABSTRACT

Disclosed is an oil jet device for cooling a piston, including: an oil cooler 4 that is disposed upstream of an oil injection nozzle 8; an oil pump 5 that is disposed upstream of the oil cooler 4; a first switching adjustment valve 6 that is disposed between the oil injection nozzle 8 and the oil cooler 4 and adjusts a flow dividing ratio at which the cooling oil from the oil cooler 4 is distributed to the oil injection nozzle 8 side and to an oil pan side; and a control unit that has an oil quantity adjustment map 4 for switching the first switching adjustment valve 6 based on a piston temperature calculation map 20 for calculating the temperature of the piston 1 using detection values acquired respectively by a cooling water temperature sensor 35, a rotation speed sensor 36 and a load sensor 37.

5 Claims, 8 Drawing Sheets

(51) Int. Cl.

| | |
|---|---|
| ***F01M 1/08*** | (2006.01) |
| ***F01M 1/16*** | (2006.01) |
| ***F01P 3/06*** | (2006.01) |
| *F01M 5/00* | (2006.01) |

(52) U.S. Cl.

CPC ..... *F01M 5/005* (2013.01); *F01M 2250/62* (2013.01); *F01M 2250/64* (2013.01); *F01P 2025/30* (2013.01); *F01P 2025/31* (2013.01); *F01P 2025/33* (2013.01); *F01P 2025/62* (2013.01); *F01P 2025/64* (2013.01); *F01P 2060/04* (2013.01)

(56) References Cited

U.S. PATENT DOCUMENTS

| | | | | |
|---|---|---|---|---|
| 4,667,630 | A * | 5/1987 | Sasaki | 123/254 |
| 7,819,093 | B2 * | 10/2010 | Yamashita et al. | 123/41.35 |
| 2005/0120982 | A1 * | 6/2005 | Ducu | 123/41.08 |
| 2007/0084431 | A1 * | 4/2007 | Omachi | 123/196 R |
| 2011/0194967 | A1 * | 8/2011 | Watanabe et al. | 418/138 |
| 2011/0253092 | A1 * | 10/2011 | Springer et al. | 123/196 R |
| 2011/0283968 | A1 * | 11/2011 | Anderson et al. | 123/196 R |
| 2012/0048228 | A1 * | 3/2012 | Chung | 123/196 R |
| 2012/0118248 | A1 * | 5/2012 | Mehring et al. | 123/41.08 |
| 2012/0227705 | A1 * | 9/2012 | Ashizawa | 123/435 |
| 2012/0285401 | A1 * | 11/2012 | Quiring et al. | 123/41.08 |

FOREIGN PATENT DOCUMENTS

| | | | |
|---|---|---|---|
| JP | 63-34322 | U | 3/1988 |
| JP | 2003-148121 | A | 5/2003 |
| JP | 2005-105886 | A | 4/2005 |
| JP | 2006-29127 | A | 2/2006 |
| JP | 2008-38757 | A | 2/2008 |

OTHER PUBLICATIONS

European Search Report, dated Jul. 1, 2014, issued in corresponding European Application No. 11855849.3.

* cited by examiner

| VALVE OPENING DEGREE | OIL INJECTION NOZZLE SIDE FLOW RATE RATIO | OIL PAN SIDE FLOW RATE RATIO |
|---|---|---|
| A0 | 0 | 4 |
| A1 | 1 | 3 |
| A2 | 2 | 2 |
| A3 | 3 | 1 |
| A4 | 4 | 0 |

| VALVE OPENING DEGREE | OIL COOLER SIDE FLOW RATE RATIO | BYPASS CIRCUIT SIDE FLOW RATE RATIO |
|---|---|---|
| B0 | 0 | 4 |
| B1 | 1 | 3 |
| B2 | 2 | 2 |
| B3 | 3 | 1 |
| B4 | 4 | 0 |

COOLING DEVICE FOR ENGINE

TECHNICAL FIELD

The present invention relates to a piston cooling device for an engine.

BACKGROUND ART

Generally in an engine, a large thermal load is applied to a piston, therefore in order to prevent abnormal combustion, such as engine knock due to high temperature of a piston head, a cooling device, which prevents erosion and abnormal combustion of the piston head by ejecting cooling oil to the rear side of the piston, is used.

As depicted in FIG. 9, which is a schematic of a main section of general piston cooling, an oil pump 5, driven by the driving force of an engine, draws up oil from an oil pan (not illustrated) of the engine while the engine is in operation, and an oil cooler 4 cools the oil by cooling water of the engine.

The oil cooled by the oil cooler 4 is injected from an oil injection nozzle 8 to a rear face of a piston 1, whereby the piston 1 is cooled.

Japanese Patent Application Laid-Open No. 2006-29127 (Patent Document 1) discloses a cooling device for a piston.

In particular Patent Document 1 discloses a technology comprising: a double structure cleaning channel constituted by a first oil passage (inside) and a second oil passage (outside) formed in a piston head unit 1*a*; a warm-up oil supply unit which supplies warm-up oil to one of the first oil passage and the second oil passage when cooling the engine; and the warm-up oil supply unit that supplies cooling oil to the other one of the first oil passage and the second oil passage when the piston temperature is high.

Patent Document 1: Japanese Patent Application Laid-Open No. 2006-29127

The oil pump 5, however, is connected to a crankshaft (not illustrated) of the engine via a gear train, hence the oil pump 5 operates simultaneously when the crankshaft of the engine rotates.

Therefore when the engine starts, the oil pump is driven and the oil in an oil pan in a cooled state is injected to the rear face of the piston, whereby the piston is kept cool.

This means that the temperature of the piston head does not rise quickly, and that it takes time until the engine reaches the best operating conditions, in other words startability is not good and fuel consumption is high.

Furthermore according to Patent Document 1, the warm-up oil supply unit that supplies a warm-up oil when cooing the engine and a heating up unit for heating oil are included, which increase the cost of the device, and is also not desirable in terms of fuel consumption.

DISCLOSURE OF THE INVENTION

With the foregoing in view, it is an object of the present invention to adjust the injection amount of the cooling coil from the oil injection nozzle, and to adjust the temperature of the cooling oil depending on whether the engine is started up (engine cooled state) or whether the engine is operating, in other words, the temperature of the piston increases quickly when the engine is started up, while over-cooling of the piston is prevented when output is at an intermediate or low level, so as to improve startability of the engine, decrease the warm-up period, improve fuel efficiency during intermediate or low output, and improve fuel consumption efficiency.

To solve this problem, the present invention provides a cooling device for an engine including an oil jet device for cooling a piston with oil, this cooling device including: a cooling water temperature sensor that detects a temperature of the engine; a rotation speed sensor that detects rotation speed of the engine; a load sensor that detects the load of the engine; a jet nozzle that is secured in a cylinder block of the engine and injects cooling oil to the rear face of the piston; an oil cooler disposed upstream of the jet nozzle on a distribution path of the cooling oil; an oil pump that is located upstream of the oil cooler and pumps the cooling oil to the oil cooler; a first switching adjustment valve that is disposed between the jet nozzle and the oil cooler, and adjusts a flow dividing ratio at which the cooling oil from the oil cooler is distributed to the jet nozzle side and to an oil pan side; and a control unit that has an oil quantity adjustment map for switching the first switching adjustment valve based on a piston temperature calculation map for calculating the temperature of the piston using the detection values acquired respectively by the temperature sensor, the rotation speed sensor and the load sensor.

Because of this configuration, the piston temperature can be calculated and deterioration of startability and fuel consumption rate of the engine, due to over-cooling of the piston, can be prevented.

In the present invention, it is preferable that the control unit adjusts a second switching adjustment valve disposed between the oil cooler and the oil pump on the distribution path of the cooling oil based on an oil temperature adjustment map which determines a flow dividing ratio at which the cooling oil from the oil pump is distributed to the oil cooler side and to a bypass circuit side which is connected between the oil cooler and the first switching adjustment valve, whereby the temperature of the cooling oil, after passing through the bypass circuit, is adjusted.

Because of this configuration, the quantity of the cooling oil that flows through the oil cooler can be adjusted, whereby fine control of the oil temperature becomes possible, an excessive increase in oil temperature can be controlled, and deterioration of oil can be prevented.

Furthermore a bypass circuit is included, therefore over-cooling of the piston due to excessive cooling of the cooling oil can be prevented.

In the present invention, it is preferable that when the engine is started or when the load is intermediate or low, the value calculated using the piston temperature calculation map is compared with a value detected by a cylinder temperature sensor for detecting a cylinder temperature of the engine and/or a value detected by a cylinder head temperature sensor for detecting a temperature of the cylinder head, and when the difference therebetween is a threshold or more, priority is given to the value(s) detected by the cylinder temperature sensor and/or the cylinder head sensor.

Because of this configuration, the temperature of the cylinder and/or the cylinder head when the engine is running can be monitored in real-time, therefore fine cooling control can be performed during transient operation, and efficient operation becomes possible.

Furthermore over-cooling of the piston in the initial phase of starting the engine can be prevented, and the fuel consumption rate in the initial phase can be improved.

When the engine is started (engine cooled state), cooling of the piston is stopped by diverting the oil from the oil pump before reaching the oil injection nozzle, so as to increase the temperature of the piston quickly, whereby startability of the engine is improved, the fuel consumption rate is improved due to a decrease in the warm-up period, and cost can be reduced.

BEST MODE FOR CARRYING OUT THE INVENTION

The present invention will now be described using the embodiments with reference to the drawings.

Dimensions, materials, shapes, relative positions or the like of the composing elements described in the embodiments are not intended to limit the scope of the invention to these embodiments, but are merely examples for explanatory purposes.

Embodiment 1

Figure 1:
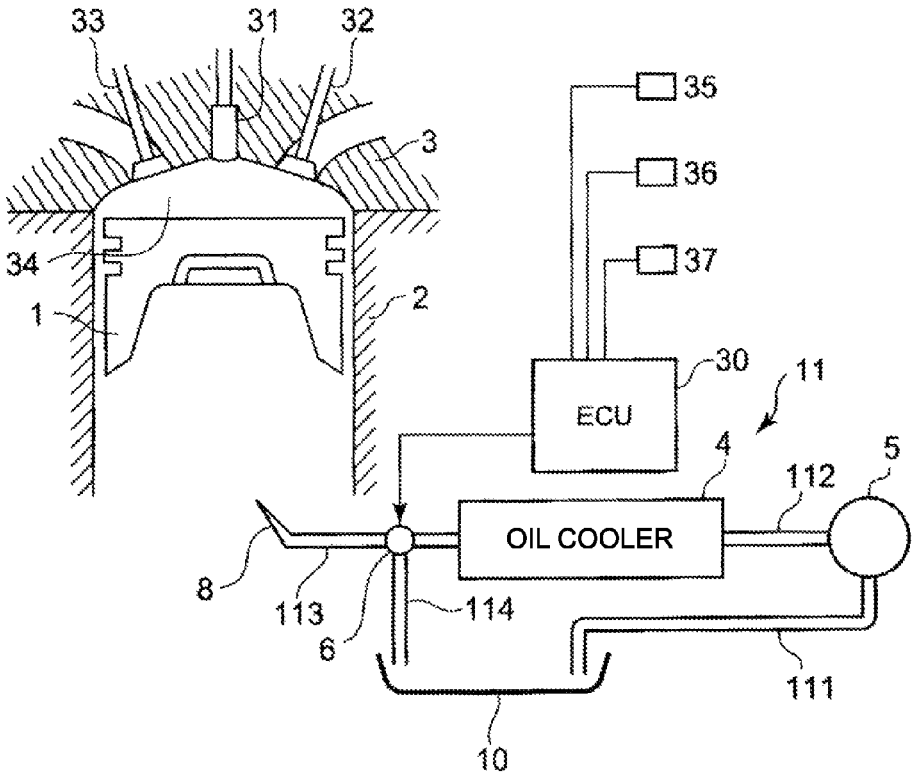
FIG. 1 is a schematic block diagram of an engine cooling device according to Embodiment 1 of the present invention.

FIG. 1 shows a piston 1 which vertically slides in a cylinder 2 formed in an engine main unit.

A cylinder head 3 is installed in an upper part of the piston 1 so as to close the cylinder 2. In the cylinder head 3, a fuel injection nozzle 31 that injects fuel into a combustion chamber 34, an inlet valve 32 that introduces air into the cylinder, and an exhaust valve 33 that exhausts combustion gas are installed.

An oil injection unit (oil injection nozzle) 8 is secured in the engine main unit (not illustrated) facing the rear face of the piston 1 in the lower part of the piston 1.

5 denotes an oil pump which is connected to a crankshaft (not illustrated) of the engine via a gear train, and is driven simultaneously with the start of the engine, to draw up cooling oil from an oil pan 10 of the engine.

An oil cooler 4 is normally installed on the side of the engine main unit, and cools the cooling oil using the cooling water of the engine.

6 denotes a first switching adjustment valve, which controls a quantity of the cooling oil, which is supplied from the oil cooler 4, to be distributed to an oil injection nozzle 8 side and to the oil pan 10 side, under control of a control unit 30.

The control unit 30 controls the first switching adjustment valve 6 based on the respective detected values acquired by a load sensor 37 (engine torque), a rotation speed sensor 36 and a cooling water temperature sensor 35.

11 denotes a distribution path, which draws up the cooling oil from the oil pan 10 using the oil pump 5 via a first oil feed tube 111 when the engine is started. The cooling oil drawn up by the oil pump 5 is fed into the oil cooler 4 via a second oil feed tube 112, and is cooled by the cooling water of the engine.

The flow of the cooled cooling oil is divided by a first switching adjustment valve 6, which is disposed in an intermediate portion of a third oil feed tube 113 based on an oil quantity adjustment map 41 (provided in the control unit 30), for determining a flow quantity ratio at which the cooling oil is distributed to the oil injection nozzle 8 side and to the oil pan 10 side, depending on the operating state of the engine.

One of the divided flows of the cooling oil is distributed to the oil injection nozzle 8 side, and is injected into the rear side of the piston 1, and cools the piston 1.

The other side of the divided flows is returned to the oil pan 10 via a fourth oil feed tube 114.

Figure 2:
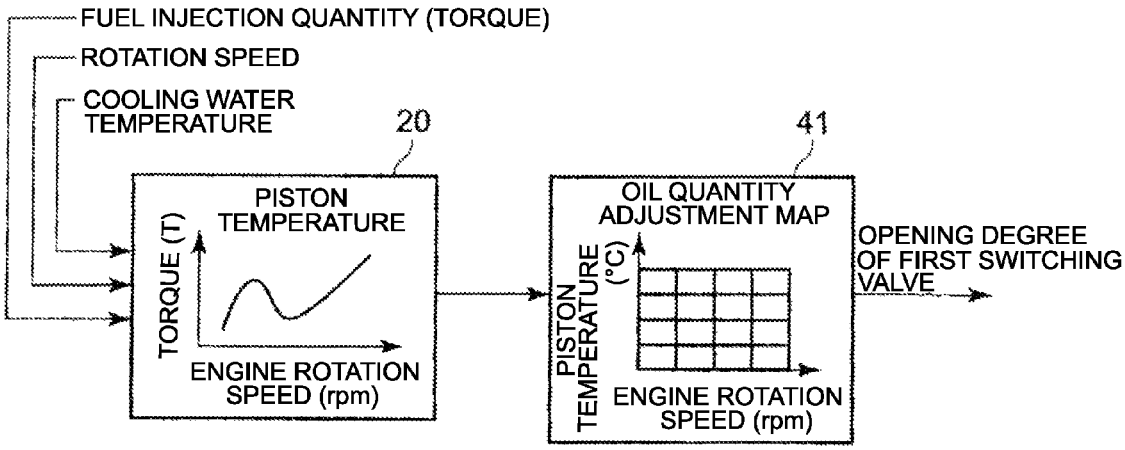
FIG. 2 is a diagram depicting a flow to control a switching valve according to Embodiment 1 of the present invention.

The first switching adjustment valve 6 adjusts the oil quantity according to the valve control flow of the first switching adjustment valve 6 shown in FIG. 2.

The operating state of the engine is calculated using a piston temperature calculation map 20 based on the detected values acquired by the cooling water temperature sensor 35, the rotation speed sensor 36 and the load sensor 37. The piston temperature calculation map 20 has a characteristic curve of the piston temperature generated by determining the temperature of the piston 1 based on experiment values, and plotting the temperature values on the abscissa as the rotation speed (rpm) and on the ordinate as the torque (T).

The load sensor 37 measures the fuel injection quantity, or an amount by which the accelerator pedal is depressed.

Based on the temperature calculated using the piston temperature calculation map 20, the flow rate ratio of the first switching adjustment valve 6 is determined using the oil quantity adjustment map 41.

Figures 3A, 3B:
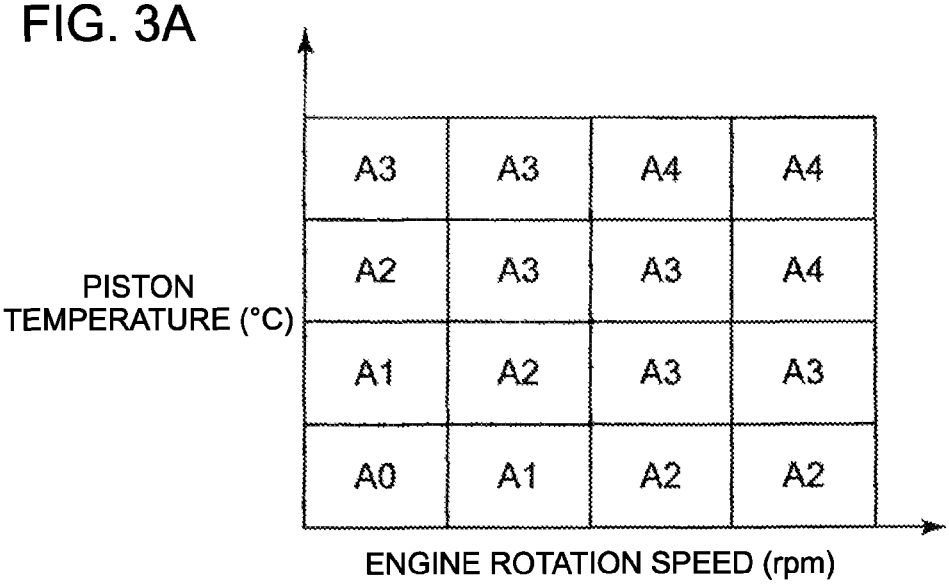
FIG. 3A shows a configuration of an oil quantity adjustment map of the present invention.
FIG. 3B shows flow rate ratios in the map.

As FIG. 3A shows, the oil quantity adjustment map 41 is divided into squared areas which are plotted on the abscissa as the engine rotation speed (rpm) and on the ordinate as the piston temperature (temperature calculated using the piston temperature calculation map 20).

In each area, the opening degree of the first switching adjustment valve (flow rate ratio) is classified into levels: A0, A1, A2, A3 and A4.

If the piston temperature is low and it is immediately after the engine started, for example, A0 is selected.

Then as FIG. 3B shows, the control unit 30 adjusts the valve position of the first switching adjustment valve 6 by setting the flow rate on the oil injection nozzle 8 side to 0 (zero), so that the flow rate on the oil pan 10 side becomes 4 (entire quantity).

As the engine warms up and the temperature of piston 1 and the engine rotation speed increases, an area to be selected sequentially changes as area A1 and area A2, and the flow rate on the oil injection nozzle 8 side and the flow rate on the oil pan 10 side are adjusted according to the operation state of the engine (determined based on the detected value acquired by each sensor).

In the case of a high-load operation state where the position temperature is high and the engine rotation speed is high, A4 is selected, and the valve position of the first switching adjustment valve 6 is adjusted by setting the flow rate on the oil injection nozzle 8 side to 4 (entire quantity), so that the flow rate on the oil pan 10 side becomes 0 (zero).

According to this embodiment, the operation state of the engine is calculated based on detected values acquired from the cooling water temperature sensor 35, the rotation speed sensor 36 and the load sensor 37, and the piston temperature is calculated using the piston temperature calculation map 20. Based on these calculation results, the injection quantity of the cooling oil to the piston 1 is finely controlled, whereby deterioration of startability of the engine and the fuel consumption rate of the engine, due to over-cooling of the piston 1, can be minimized.

Embodiment 2

Figure 4:
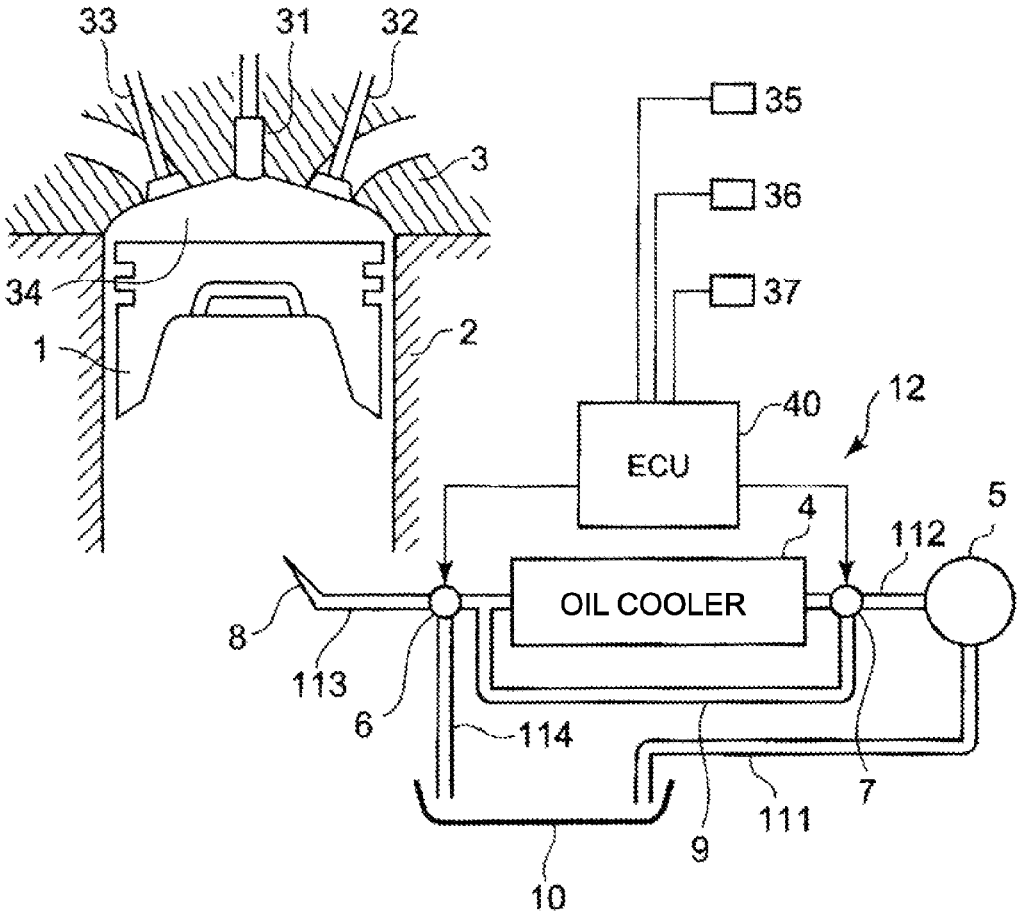
FIG. 4 is a schematic block diagram of an engine cooling device according to Embodiment 2 of the present invention.

An engine cooling device according to Embodiment 2 will be described with reference to the schematic block diagram shown in FIG. 4.

A composing element the same as in Embodiment 1 is denoted with a same reference symbol, for which description is omitted.

In a distribution path 12, the cooling oil is drawn up from the oil pan 10 by the oil pump 5 via the first oil feed tube 111. A second switching adjustment valve 7 is inserted into the intermediate portion of the second oil feed tube 112 connecting an oil pump 5 and the oil cooler 4.

The third oil feed tube 113, which has the first switching adjustment valve 6 in the intermediation portion, is disposed at the downstream side of the distribution path 12 of the oil cooler 4.

The oil injection nozzle 8 is disposed further at the downstream side.

The first switching adjustment valve 6 is controlled (divides flow) based on an oil quantity adjustment map 41, which is disposed in the control unit 40, and determines a ratio of quantity of oil distributed to the oil injection nozzle 8 side and to the oil pan 10 side.

One of the controlled (divided) flows of the cooling oil is distributed to the oil injection nozzle 8 side, is injected into the rear side of the piston 1, and cools the piston 1.

The other side of the divided flows is returned to the oil pan 10 via the fourth oil feed tube 114.

A second switching adjustment valve 7 is connected to a bypass circuit 9, of which one end is connected between the first switching adjustment valve 6 of the third oil feed tube 113 and the oil cooler 4, and the other end is connected to the second switching adjustment valve 7.

The second switching adjustment valve 7 is disposed for dividing the flow of the cooling oil into the oil cooler 4 side and the bypass circuit 9 side, so as to adjust the temperature when the cooling oil cooled by the oil cooler 4 and the cooling oil, which passed through the bypass circuit 9, are mixed again in the third oil feed tube 113.

The second switching adjustment valve 7 is controlled using the oil temperature adjustment map 51 disposed in the control unit 40, generated from the result of calculating the operation state of the engine using the piston temperature calculation map 20 based on the detected values acquired by the cooling water temperature sensor 35, the rotation speed sensor 36 and the load sensor 37.

Figure 5:
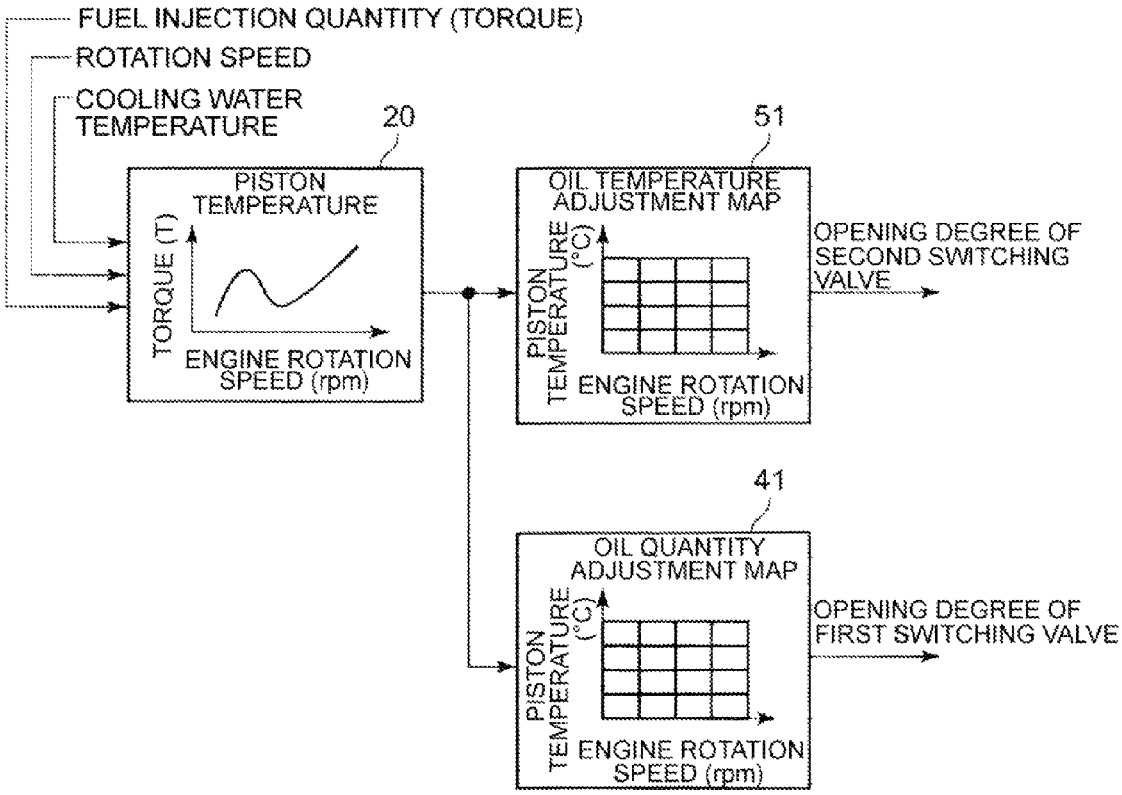
FIG. 5 is a diagram depicting a flow to control a switching valve according to Embodiment 2 of the present invention.

The oil quantity adjustment by the second switching adjustment valve 7 is performed according to a valve control flow by the second switching adjustment valve 7 shown in FIG. 5.

The operation state of the engine is calculated using the piston temperature calculation map 20 based on the detected values acquired by the cooling water temperature sensor 35, the rotation speed sensor 36 and the load sensor 37.

Based on the temperature calculated using the piston temperature calculation map 20, the flow rate ratio of the second switching adjustment valve 7 is determined using the oil temperature adjustment map 51.

Figures 6A, 6B:
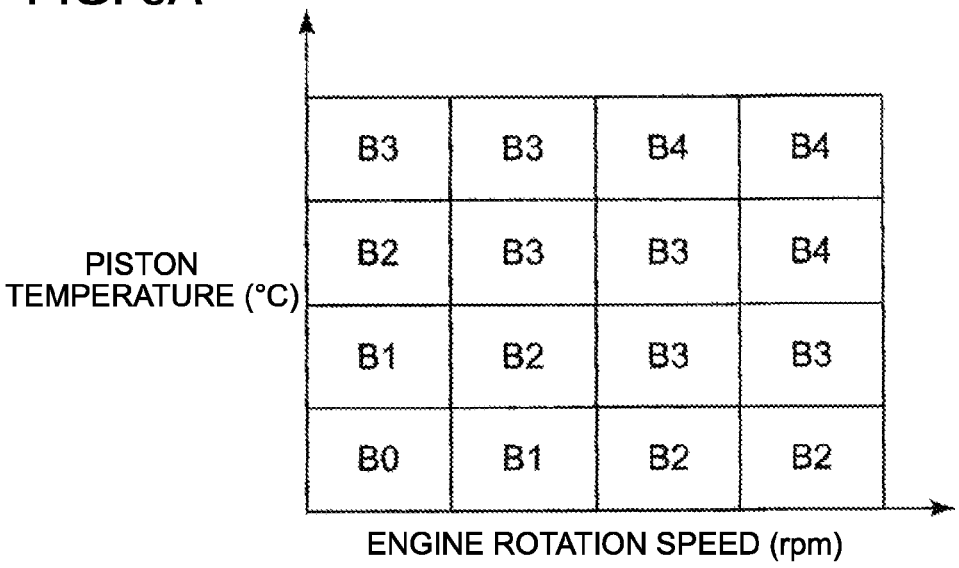
FIG. 6A shows a configuration of an oil quantity adjustment map of the present invention.
FIG. 6B shows flow rate ratios in the map.
Figure 7:
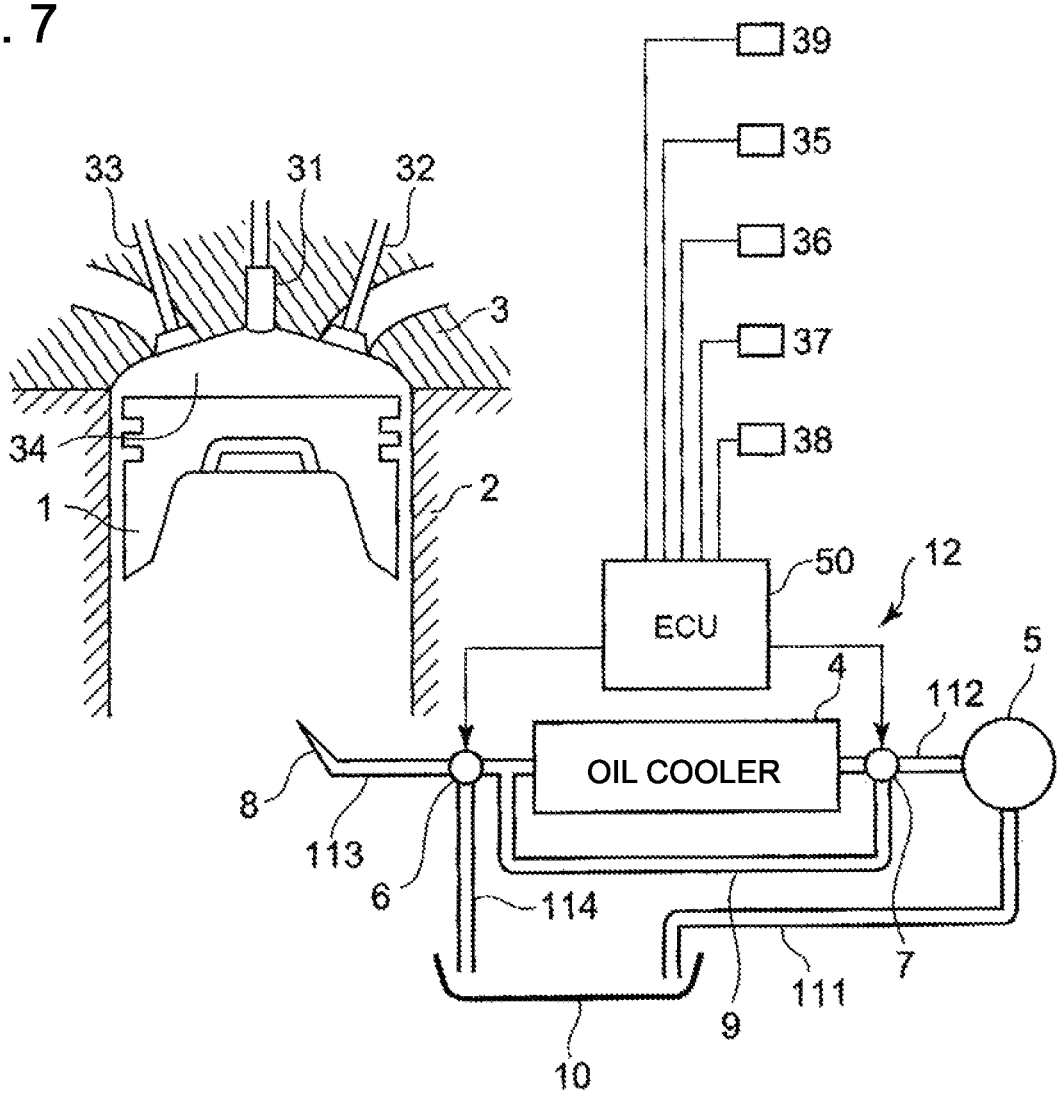
FIG. 7 is a schematic block diagram of an engine cooling device according to Embodiment 3 of the present invention.

As FIG. 6A shows, the oil temperature adjustment map 51 is divided into squared areas which are plotted on the abscissa as the engine rotation speed (rpm), and on the ordinate as the piston temperature (temperature calculated using the piston temperature calculation map 20).

In each area, the opening degree of the second switching adjustment valve (flow dividing ratio) is classified into levels: B0, B1, B2, B3 and B4.

If the piston temperature is low and it is immediately after the engine started, for example, B0 is selected.

Then as FIG. 6B shows, the control unit 40 adjusts the valve position of the second switching adjustment value 7 by setting the flow rate of the oil cooler side to 0 (zero), so that the flow rate on the bypass circuit 9 side becomes 4 (entire quantity).

As the engine warms up and the temperature of the piston 1 rises and the engine rotation speed increases, an area to be selected sequentially changes as area B1 and area B2, and the flow rate on the oil cooler 4 side and the flow rate on the bypass circuit 9 side are adjusted according to the operation state of the engine (determined based on the detected value acquired by each sensor).

In the case of high-load operation state where the piston temperature is high and the engine rotation speed is high, B4 is selected, and the valve position of the second switching adjustment valve 7 is adjusted by setting the flow rate on the oil cooler 4 side to 4 (entire quantity), so that the flow rate on the bypass circuit 9 side becomes 0 (zero).

The control of the first switching adjustment valve 6 is the same as Embodiment 1, so description thereof is omitted.

According to this embodiment, with the bypass circuit 9 of the oil cooler 4 being installed, the operation state of the engine is calculated based on the detected values acquired from the cooling water temperature sensor 35, the rotation speed sensor 36 and the load sensor 37, and the piston temperature is calculated using the piston temperature calculation map 20. Based on the calculated temperature of the piston 1, the quantity of oil distributed to the oil cooler 4 and the quantity of oil distributed to the bypass circuit 9 is controlled, whereby the temperature of the cooling oil is finely controlled, accuracy of controlling the temperature of the piston 1 is improved, and deterioration of the fuel consumption rate can be prevented.

Embodiment 3

Figure 8:
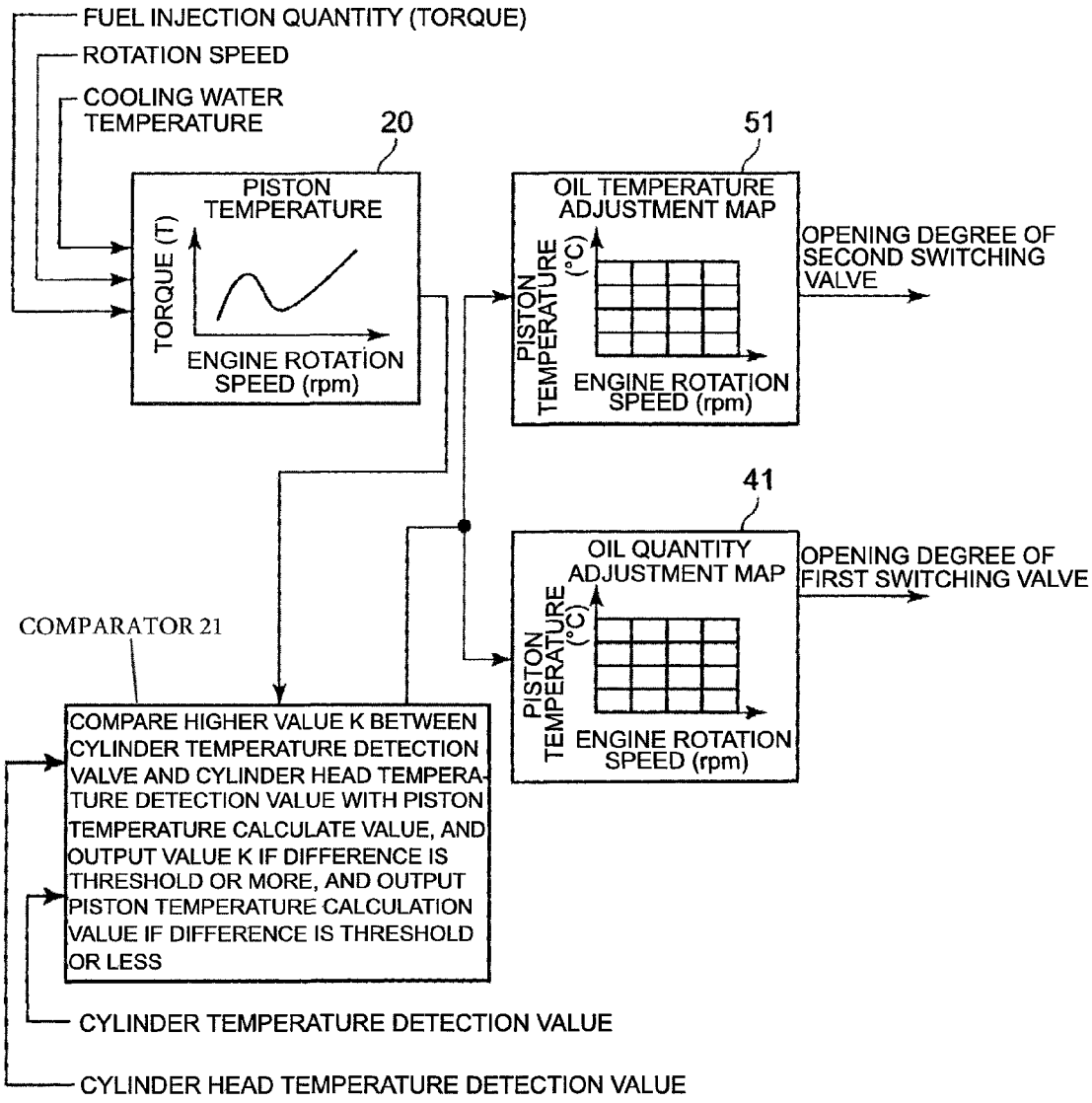
FIG. 8 is a diagram depicting a flow to control a switching valve according to Embodiment 3 of the present invention.
Figure 9:
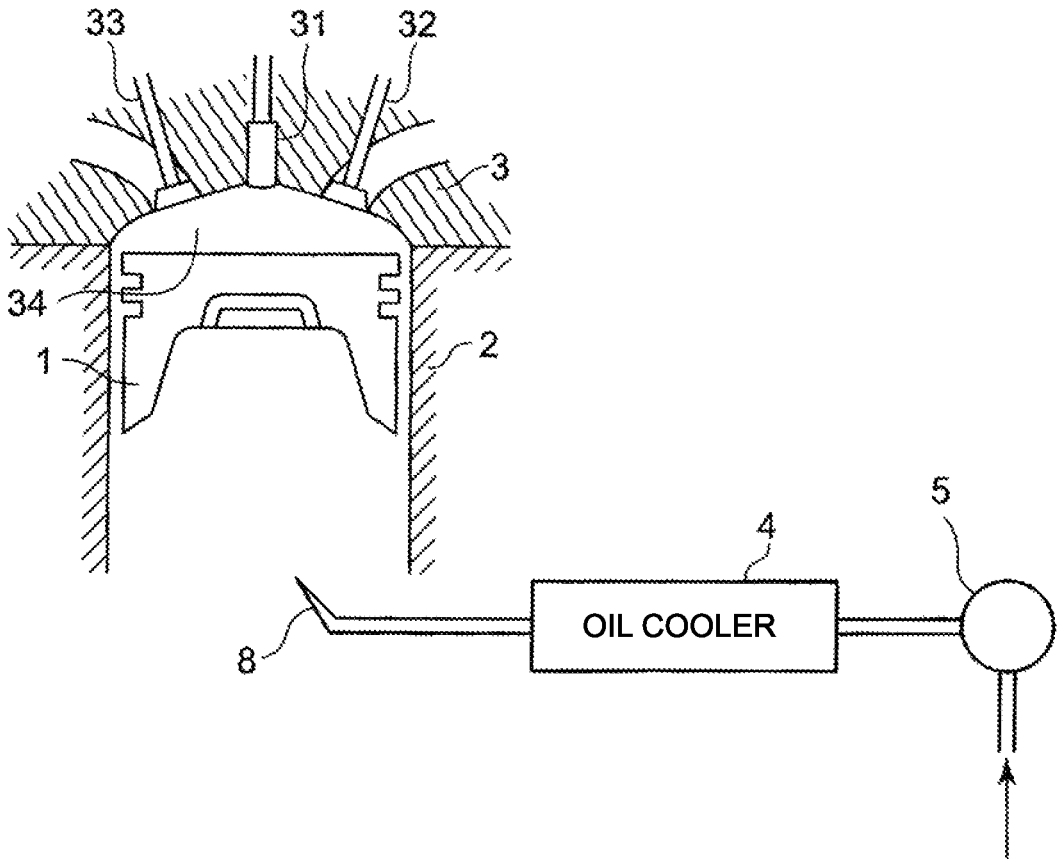
FIG. 9 is a diagram depicting a prior art.

An engine cooling device according to Embodiment 3 will be described with reference to the schematic block diagram shown in FIG. 8.

A composing element the same as in Embodiment 1 or Embodiment 2 is denoted with a same reference symbol, for which description is omitted.

In the distribution path 12, the cooling oil is drawn up from the oil pan 10 by the oil pump 5 via the first oil feed tube 111. The second switching adjustment valve 7 is inserted into the second oil feed tube connecting the oil pump 5 and the oil cooler 4.

The third oil feed tube 113, which has the first switching adjustment valve 6 in the intermediate portion, is disposed in the downstream side of the distribution path 12 of the oil cooler 4, and the oil injection nozzle 8 is disposed further at the downstream side.

The second switching adjustment valve 7 is connected to the bypass circuit 9, of which one end is connected between the first switching adjustment valve 6 of the third oil feed tube 113 and the oil cooler 4, and the other end is connected to the second switching adjustment valve 7.

A control unit 50 has the oil quantity adjustment map 41 for controlling the first switching adjustment valve 6, and the oil temperature adjustment map 51 for controlling the second switching adjustment valve 7.

In order to recognize the operation state of the engine, detected values acquired by the cooling water temperature sensor 35, the rotation speed sensor 36, the load sensor 47 and a cylinder temperature sensor 38 (and/or a cylinder head temperature sensor 39) are input to the control unit 50.

Control of this embodiment will now be described according to the valve control flow of the first switching adjustment valve 6 and the second switching adjustment valve 7 in FIG. 8.

To recognize the operation state of the engine, the temperature of the piston 1 is calculated using the piston temperature calculation map 20 based on the detected values acquired by the cooling water temperature sensor 35, the rotation speed sensor 36 and the load sensor 47.

On the other hand, the cylinder temperature sensor 38 is installed in the cylinder 2, and the cylinder head temperature sensor 39 is installed in the cylinder head (not illustrated), so as to directly detect the temperature using these sensors respectively.

It is assumed that the detected value by the cylinder temperature sensor 38 and the detected value by the cylinder head temperature sensor 39 are compared, and the higher temperature in the comparison result is the detected value K.

If the difference between the detected value K and the piston temperature calculation value calculated using the piston temperature calculation map 20 is a threshold value or more, the priority is given to the detected value K, and the detected value K is regarded as the temperature of the piston 1, and becomes a control element in the oil quantity adjustment map 41 and the oil temperature adjustment map 51.

If the difference is the threshold or less, the piston temperature calculation value is used.

The method for controlling the oil quantity adjustment map 41 and the oil temperature adjustment map 51 is the same as Embodiment 2, therefore description is omitted.

In this embodiment, the detected value by the cylinder temperature sensor 38 and the detected value by the cylinder head temperature sensor 39 are compared in comparator 21, and priority is given to the higher value, but only one of the detected value by the cylinder temperature sensor 38 and the detected value by the cylinder head temperature sensor 39 may be used.

In this case, cost can be reduced.

There may be a situation where the temperature calculated using the piston temperature calculation map 20 and the actual temperature may differ, depending on the environment for the engine (e.g. cold climate, high altitude). However, according to this embodiment, the cylinder temperature sensor 38 and the cylinder head temperature sensor 39 directly measure the respective temperature, therefore, in use of the measured values as control elements of the oil quantity adjustment map 41 and the oil temperature adjustment map 51, it is possible to monitor in real-time the temperature of the cylinder 2 and the temperature of the cylinder head, when the engine is operating. Therefore fine cooling control is possible during transient operation.

INDUSTRIAL APPLICABILITY

The present invention can be suitably applied to an engine cooling device for which improvement of startability of the engine and fuel consumption is performed by preventing over-cooling of the piston when the engine, having the piston cooling device, is started.

The invention claimed is:

1. A cooling device for an engine including an oil jet device for cooling a piston with oil, the cooling device comprising:

a cooling water temperature sensor configured to detect a temperature of the engine;

a rotation speed sensor configured to detect rotation speed of the engine;

a load sensor configured to detect load of the engine;

at least one of a cylinder temperature sensor configured to directly measure a cylinder temperature of the engine and a cylinder head temperature sensor configured to directly measure a temperature of the cylinder head of the engine;

a jet nozzle secured in a cylinder block of the engine and configured to inject cooling oil onto the rear face of the piston;

an oil cooler disposed upstream of the jet nozzle on a distribution path of the cooling oil;

an oil pump located upstream of the oil cooler and configured to pump the cooling oil to the oil cooler;

a first switching adjustment valve disposed between the jet nozzle and the oil cooler, and configured to adjust a flow dividing ratio at which the cooling oil from the oil cooler is distributed to the jet nozzle side and to an oil pan side; and a control unit connected to the first switching adjustment valve to control the first switching adjustment valve, and configured to receive detection values from the cooling water temperature, the rotation speed sensor, the load sensor, and the at least one of the cylinder temperature sensor and the cylinder head temperature sensor, the control unit including, a piston temperature calculation map that determines the temperature of the piston using the detection values acquired respectively by the cooling water temperature sensor, the rotation speed sensor, and the load sensor, a comparator that compares the temperature of the piston determined by the piston temperature calculation map with a value calculated based on at least one of the received detection values from the cylinder temperature sensor and the cylinder head temperature sensor, and outputs the calculated value as the temperature of the piston when a difference between the determined temperature of the piston and the calculated value is equal to or greater than a threshold value, and outputs the determined temperature of the piston as the temperature of the piston when the difference is smaller than the threshold value, and an oil quantity adjustment map that determines an operation amount of the first switching adjustment value based on the temperature of the piston determined by the comparator.

2. The cooling device for an engine according to claim 1, wherein:

the cooling device includes both of the cylinder temperature sensor and the cylinder head temperature sensor, wherein the comparator compares received detection values from the cylinder temperature sensor and the cylinder head temperature sensor, and outputs a larger one of the detected values from the cylinder temperature sensor and the cylinder head temperature sensor as the calculated value.

3. The cooling device for an engine according to claim 1, further comprising:

a second switching adjustment valve, connected to the control unit, disposed on the distribution path of the cooling oil between the oil cooler and the oil pump; and a bypass circuit that extends between the second switching adjustment valve and the distribution path between the oil cooler and the first switching adjustment valve, the control unit further including, an oil temperature adjustment map that determines a flow dividing ratio at which the cooling oil from the oil pump is distributed to an oil cooler side and to the bypass circuit based on the temperature of the piston determined by the comparator, and determines an operation amount of the second switching adjustment valve based on the determined flow dividing ratio.

4. The cooling device for an engine according to claim 1, wherein the oil quantity adjustment map determines the operation amount of the first switching adjustment value based on the temperature of the piston determined by the comparator and the detected rotation speed of the engine.

5. The cooling device for an engine according to claim 3, wherein the oil temperature adjustment map determines the flow dividing ration based on the temperature of the piston determined by the comparator and the detected rotation speed of the engine.

* * * * *